US009849672B2

(12) United States Patent
Ge et al.

(10) Patent No.: US 9,849,672 B2
(45) Date of Patent: Dec. 26, 2017

(54) FLUID EJECTION APPARATUS INCLUDING A PARASITIC RESISTOR

(71) Applicant: HEWLETT-PACKARD DEVELOPMENT COMPANY, L.P., Houston, TX (US)

(72) Inventors: Ning Ge, Palo Alto, CA (US); Hang-Ru Goy, Singapore (SG); Boon Bing Ng, Singapore (SG); Shane O'Brien, Leixlip (IE); Mun Hooi Yaow, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/127,548

(22) PCT Filed: Apr. 3, 2014

(86) PCT No.: PCT/US2014/032834

§ 371 (c)(1),
(2) Date: Sep. 20, 2016

(87) PCT Pub. No.: WO2015/152926

PCT Pub. Date: Oct. 8, 2015

(65) Prior Publication Data

US 2017/0151783 A1 Jun. 1, 2017

(51) Int. Cl.

| | |
|---|---|
| ***B41J 2/14*** | (2006.01) |
| ***B41J 2/16*** | (2006.01) |
| ***B41J 2/045*** | (2006.01) |

(52) U.S. Cl.

CPC ..... *B41J 2/14112* (2013.01); *B41J 2/04533* (2013.01); *B41J 2/14056* (2013.01); *B41J 2/1601* (2013.01); *B41J 2/1632* (2013.01)

(58) Field of Classification Search

CPC .... B41J 2/14112; B41J 2/1412; B41J 2/1429; B41J 2/14088; B41J 2/04533; B41J 2/14056; B41J 2/04535

See application file for complete search history.

(56) References Cited

U.S. PATENT DOCUMENTS

| | | | | |
|---|---|---|---|---|
| 4,251,824 A * | 2/1981 | Hara | ..... | B41J 2/04533 347/15 |
| 5,036,897 A | 8/1991 | Tamura et al. | | |
| 6,474,788 B1 * | 11/2002 | Saito | ..... | B41J 2/14056 347/58 |

(Continued)

FOREIGN PATENT DOCUMENTS

| | | |
|---|---|---|
| JP | 9207337 | 8/1997 |
| JP | 2013-099938 | 5/2013 |

(Continued)

OTHER PUBLICATIONS

Sen, et al. Droplet Ejection Performance of a Monolithic Thermal Inkjet Print Head. Jun. 21, 2007.

*Primary Examiner* — Juanita D Jackson
(74) *Attorney, Agent, or Firm* — HP Inc. Patent Department

(57) ABSTRACT

An example provides a fluid ejection apparatus including a first firing resistor and a second firing resistor to selectively cause fluid to be ejected through a single nozzle, and a parasitic resistor arranged to add a parasitic resistance to the first firing resistor.

20 Claims, 8 Drawing Sheets

(56) References Cited

U.S. PATENT DOCUMENTS

| | | | | |
|---|---|---|---|---|
| 6,578,951 | B2 | 6/2003 | Ozaki et al. | |
| 7,465,031 | B2 | 12/2008 | Eguchi et al. | |
| 2005/0225582 | A1* | 10/2005 | Tomita | B41J 2/04533 347/12 |
| 2006/0103693 | A1 | 5/2006 | Min et al. | |
| 2009/0033695 | A1 | 2/2009 | Burton | |
| 2013/0063527 | A1* | 3/2013 | Ge | B41J 2/14056 347/63 |

FOREIGN PATENT DOCUMENTS

| | | |
|---|---|---|
| KR | 10-2010-0021166 | 2/2010 |
| WO | WO2012011923 | 1/2012 |

* cited by examiner

FLUID EJECTION APPARATUS INCLUDING A PARASITIC RESISTOR

BACKGROUND

Inkjet technology is widely used for precisely and rapidly dispensing small quantities of fluid. Inkjet printheads eject drops of fluid, such as, for example, ink, from a nozzle by creating a short pulse of increased pressure within a firing chamber. During printing, this ejection operation can repeat thousands of time per second. One way to create pressure in the firing chamber is by heating the fluid in the firing chamber. A thermal inkjet (TIJ) device may include a heating element, such as, for example, a firing resistor, in the firing chamber. To eject a drop of the fluid, an electrical current may be passed through the heating element, and as the heating element generates heat, a portion of the fluid within the firing chamber may be vaporized. The vapor may rapidly expand, forcing a drop of fluid out of the firing chamber and through the nozzle. The electrical current across the heating element may then be turned off, allowing the heating element to cool. As the vapor bubble rapidly collapses, more fluid my be drawn into the firing chamber.

BRIEF DESCRIPTION Of THE DRAWINGS

The detailed descriptive section references the drawings, wherein.

Figure 1:
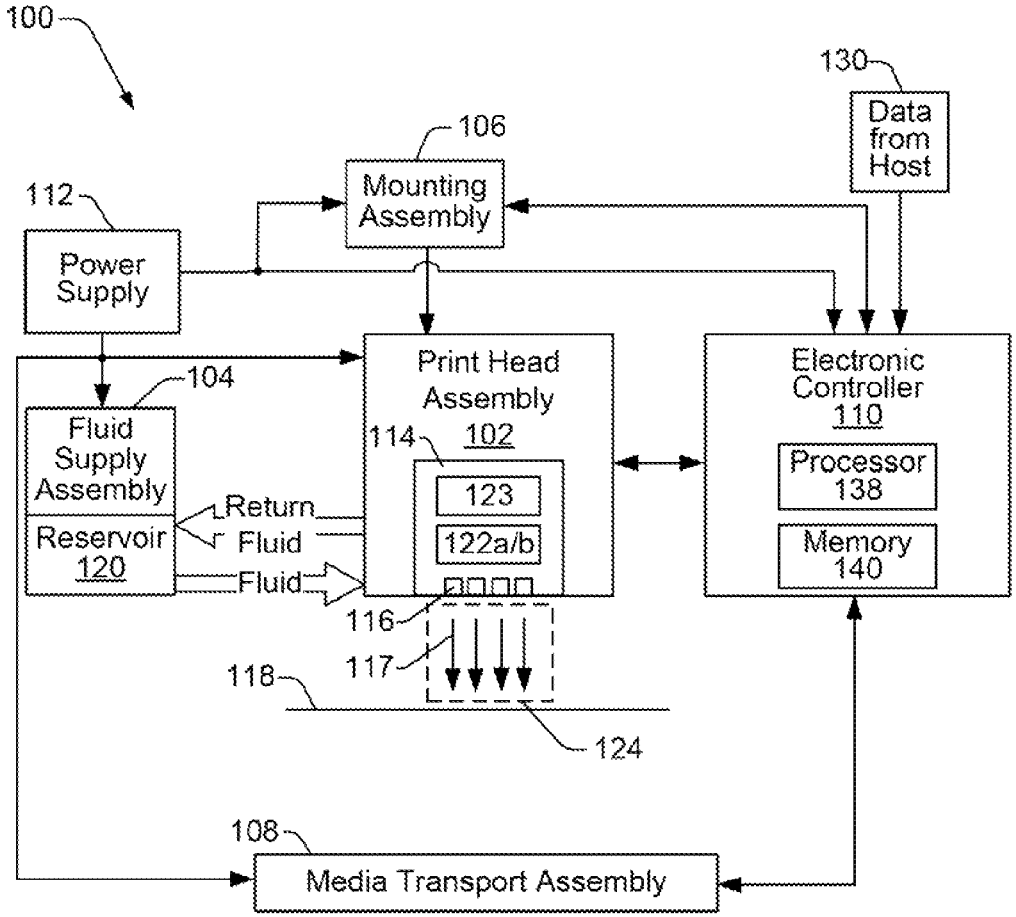
FIG. 1 is a block diagram of an example of a fluid ejection system suitable for incorporating a parasitic resistor to add a parasitic resistance to a firing resistor.

all in which various embodiments may be implemented.

Examples are shown in the drawings and described in detail below. The drawings are not necessarily to scale, and various features and views of the drawings may be shown exaggerated in scale or in schematic for clarity and/or conciseness. The same part numbers may designate the same or similar parts throughout the drawings.

DETAILED DESCRIPTION

There remains continued interest in increasing print speeds, print quality, and printing versatility. Among the solutions to increasing print speeds is increased printhead swath, but this solution may pose a cost challenge for printheads using an increased printhead silicon area to achieve the increased printhead swath. A solution to high-quality, versatile printing may include dual drop weight configurations including individual fluid chambers and associated nozzles having different drop volumes. For example, a printhead may include some fluid chamber/nozzle sets designed to eject drops having a smaller size than other ones of the fluid chamber/nozzle sets. While this configuration may allow for different drop characteristics for large and small drops from a single inkjet printhead, the print speed and nozzle density may be reduced given the nozzle redundancy.

Described herein are various implementations of a fluid ejection apparatus including a first firing resistor and a second firing resistor to selectively cause fluid to be ejected through a single nozzle, and a parasitic resistor arranged to add a parasitic resistance to the first firing resistor. In various implementations, the first firing resistor may produce a fluid drop having a first size and the second firing resistor may produce a fluid drop having a second size larger than the first size. In various ones of these implementations, the fluid ejection apparatus may include a single firing line arranged to provide a same firing voltage to the first firing resistor and the second firing resistor, and the parasitic resistor may operate to control an amount of energy, and associated stress, across the first firing resistor, which may increase the life of the first firing resistor as compared to apparatuses not including the parasitic resistor.

Turning now to FIG. 1, illustrated is a block diagram of an example fluid ejection system 100 suitable for incorporating a parasitic resistor as disclosed herein. In various implementations, the fluid ejection system 100 may comprise a thermal inkjet printer or printing system. The fluid ejection system 100 may include a printhead assembly 102, a fluid supply assembly 104, a mounting assembly 106, a media transport assembly 108, an electronic controller 110, and at least one power supply 112 to provide power to the various electrical components of fluid ejection system 100.

The printhead assembly 102 may include at least one printhead 114. The printhead 114 may include one or more printhead dies to supply a fluid, such as ink, for example, to a plurality of nozzles 116. At least one of the printhead dies may include a first firing resistor 122*a* and a second firing resistor 122*b* to selectively cause fluid to be ejected through a single one of the nozzles 116, and a parasitic resistor 123 arranged to add a parasitic resistance to the first firing resistor 122*a*, as described more fully herein.

The plurality of nozzles 116 may eject ejects drops of the fluid toward a print media 118 so as to print onto the print media 118. The print media 118 may be any type of suitable sheet or roll material, such as, for example, paper, card stock, transparencies, polyester, plywood, foam board, fabric, canvas, and the like. The nozzles 116 may be arranged in one or more columns or arrays such that properly sequenced ejection of fluid from nozzles 116 may cause characters, symbols, and/or other graphics or images to be printed on the print media 118 as the printhead assembly 102 and print media 118 are moved relative to each other.

The fluid supply assembly 104 may supply fluid to the printhead assembly 102 and may include a reservoir 120 for storing the fluid. In general, fluid may flow from the reservoir 120 to the printhead assembly 102, and the fluid supply assembly 104 and the printhead assembly 102 may form a one-way fluid delivery system or a recirculating fluid delivery system. In a one-way fluid delivery system, substantially all of the fluid supplied to the printhead assembly 102 may be consumed during printing. In a recirculating fluid delivery system, however, only a portion of the fluid supplied to the printhead assembly 102 may be consumed during printing. Fluid not consumed during printing may be returned to the fluid supply assembly 104. The reservoir 120 of the fluid supply assembly 104 may be removed, replaced, and/or refilled.

The mounting assembly 106 may position the printhead assembly 102 relative to the media transport assembly 108, and the media transport assembly 108 may position the print media 118 relative to the printhead assembly 102. In this configuration, a print zone 124 may be defined adjacent to the nozzles 116 in an area between the printhead assembly 102 and print media 118. In some implementations, the printhead assembly 102 is a scanning type printhead assembly. As such, the mounting assembly 106 may include a carriage for moving the printhead assembly 102 relative to the media transport assembly 108 to scan the print media 118. In other implementations, the printhead assembly 102 is a non-scanning type printhead assembly. As such, the mounting assembly 106 may fix the printhead assembly 102 at a prescribed position relative to the media transport assembly 108. Thus, the media transport assembly 108 may position the print media 118 relative to the printhead assembly 102.

The electronic controller 110 may include a processor 138, memory 140, firmware, software, and other electronics for communicating with and controlling the printhead assembly 102, mounting assembly 106, and media transport assembly 108. Memory 140 may include both volatile (e.g., RAM) and nonvolatile (e.g., ROM, hard disk, floppy disk, CD-ROM, etc.) memory components comprising computer/processor-readable media that provide for the storage of computer/processor-executable coded instructions, data structures, program modules, and other data for the printing system 100. The electronic controller 110 may receive data 130 from a host system, such as a computer, and temporarily store the data 130 in memory 140. Typically, the data 130 may be sent to the printing system 100 along an electronic infrared, optical, or other information transfer path. The data 130 may represent, for example, a document and/or file to be printed. As such, the data 130 may form a print job for the printing system 100 and may include one or more print job commands and/or command parameters.

In various implementations, the electronic controller 110 may control the printhead assembly 102 for ejection of fluid drops 117 from the nozzles 116. Thus, the electronic controller 110 may define a pattern of ejected fluid drops 117 that form characters, symbols, and/or other graphics or images on the print media 118. The pattern of ejected fluid drops 117 may be determined by the print job commands and/or command parameters from the data 130.

In various implementations, the printing system 100 is a drop-on-demand thermal inkjet printing system with a thermal inkjet (TIJ) printhead 114 suitable for implementing a printhead die 114 such that the firing resistors 122*a/b* thermally eject the fluid from the fluid chamber of the fluid ejection apparatus 100 through the respective nozzle 116. In some implementations, the printhead assembly 102 may include a single TIJ printhead 114. In other implementations, the printhead assembly 102 may include a wide array of TIJ printheads 114.

Figure 2:
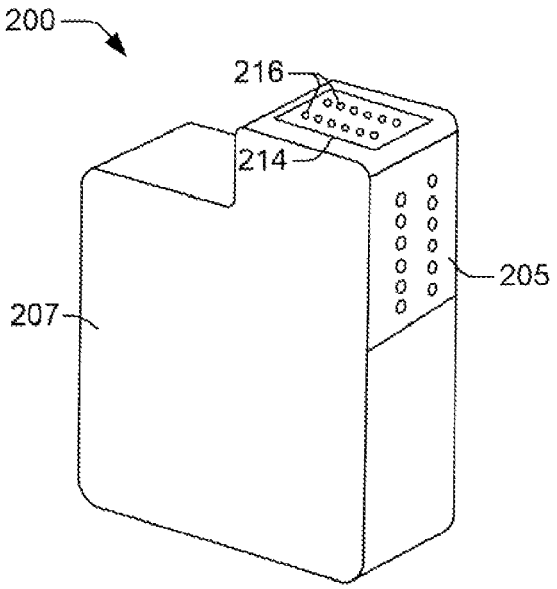
FIG. 2 is a perspective view of an example fluid ejection cartridge suitable for incorporating a parasitic resistor to add a parasitic resistance to a firing resistor.

In various implementations, the printhead assembly 102, fluid supply assembly 104, and reservoir 120 may be housed together in a replaceable device such as an integrated printhead cartridge. FIG. 2 is a perspective view of an example inkjet cartridge 200 that may include the printhead assembly 102, ink supply assembly 104, and reservoir 120, according to an implementation of the disclosure.

In addition to one or more printheads 114, inkjet cartridge 200 may include electrical contacts 205 and an ink (or other fluid) supply chamber 207. In some implementations, the cartridge 200 may have a supply chamber 207 that stores one color of ink, and in other implementations it may have a number of chambers 207 that each store a different color of ink. The electrical contacts 205 may carry electrical signals to and from a controller (such as, e.g., the electrical controller 110 described herein with reference to FIG. 1) and power (from the power supply 112 described herein with reference to FIG. 1) to cause the ejection of ink drops through the nozzles 216.

Figure 3:
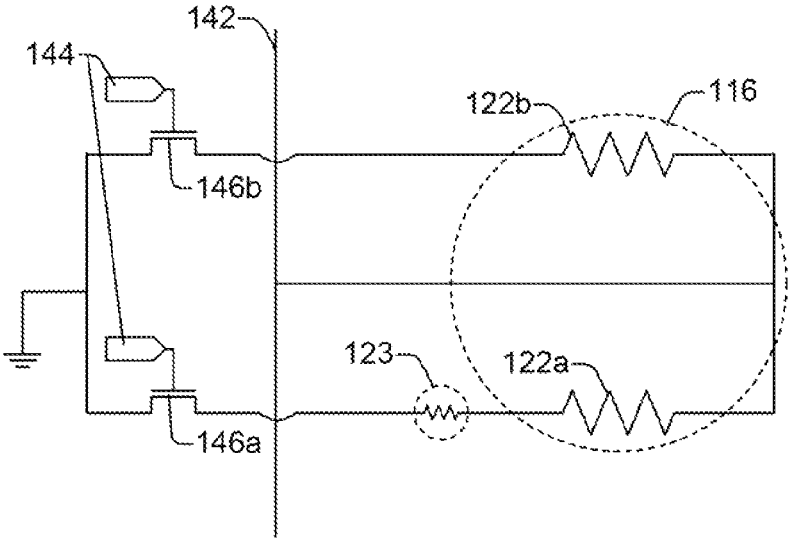
FIG. 3 is a circuit diagram for an example fluid ejection apparatus including a parasitic resistor.

FIG. 3 illustrates an example of a circuit diagram for a portion of an example fluid ejection apparatus including a first firing resistor 122*a* and a second firing resistor 122*b* to selectively cause fluid to be ejected through a single nozzle 116 (depicted by hashed lines for discussion purposes), and a parasitic resistor 123 arranged to add a parasitic resistance to the first firing resistor 122*a* to control an amount of energy across the first firing resistor 122*a*.

As illustrated, the first firing resistor 122*a* and the second firing resistor 122*b* are arranged to receive the same firing voltage and the same firing pulse from the firing line 142. Select circuitry 144, which may operate by direct addressing, matrix addressing, or smart drive chip, may facilitate, at least in part, ejection of the fluid by the first firing resistor 122*a* and/or the second firing resistor 122*b*, by selectively opening or closing drive transistors 146*a*, 146*b* coupled between the selected resistor 122*a*, 122*b*, respectively, and ground, thereby allowing current to flow across the selected resistor. For example, the select circuitry 144 may select the first firing resistor 122*a* to fire, the second firing resistor 122*b* to fire, or both the first firing resistor 122*a* and the second firing resistor 122*b* to fire. Selection of which resistor to fire by the select circuitry 144 may be carried out by a processor (such as, e.g., the processor 138 described herein with reference to FIG. 1 or another processor of the fluid ejection device or system, or another controlling device, or a combination thereof).

In various implementations, the first firing resistor 122*a* and the second firing resistor 122*b* may have different resistances. For at least some of these implementations, the resistors 122*a*, 122*b* may be configured with differing resistances in order to produce fluid drops of differing sizes. For example, the first firing resistor 122*a* may be a low drop-weight resistor and the second firing resistor 122*b* may be a high drop-weight resistor, with the second firing resistor 122*b* having a resistance greater than a resistance of the first firing resistor 122*a* such that the second firing resistor 122*b* is to produce a fluid drop having a size larger than a fluid drop produced by the first firing resistor 122*a*. In various implementations, the differing resistances may be achieved by forming the first firing resistor 122*a* with an area/size greater than the area/size of the second firing resistors 122*b*.

In various implementations, producing fluid drops of differing sizes may allow the fluid ejection apparatus to produce images across a wider range of resolution, saturation, or speed, or a combination thereof. For example, printing using the low drop-weight first firing resistor 122*a* may produce smaller fluid drops to print with higher resolution, while printing using both the low drop-weight first firing resistor 122*a* and the high drop-weight first firing resistor 122*b* may eject a larger amount of fluid for higher speed printing or higher color saturation.

In the configuration shown in FIG. 3 in which the first firing resistor 122*a* and second firing resistor 122*b* are arranged to receive a firing pulse from the same firing line 142 at the same time when both the first firing resistor 122*a* and second firing resistor 122*b* are selected to fire by the select circuitry 144, the energy stress and power density to the smaller first firing resistor 122*a* may be higher than that of the second firing resistor 122*b* under the same firing pulse width and applied voltage. In some cases, this increases energy stress may result in earlier failure of the first firing resistor 122*a*. The energy, E, delivered to each of the resistors 122*a*, 122*b* is generally governed by the following equation:

$$E = P * PW$$
$$= \frac{V^2}{R_{bb}} * PW$$
$$= \frac{V^2}{R_{122} + R_{parasitic}} * PW$$

where P is power, PW is pulse width, V is voltage across the resistor, $R_{bb}$ is bulk resistance, $R_{122}$ is the resistance of the resistor 122*a* or 122*b*, and $R_{parasitic}$ is the parasitic resistance of resistor 122*a* or 122*b*. As such, introducing a parasitic resistance in the electrical path of the smaller first firing resistor 122*a* may reduce the energy delivered to the first firing resistor 122*a* when both the first firing resistor 122*a* and the second firing resistor 122*b* are fired simultaneously. The reduced energy may result in an increased life of the first firing resistor 122*a* than that experienced for configurations without the added parasitic resistance.

To increase the parasitic resistance of the first firing resistor 122*a* to control the energy delivered to the first firing resistor 122*a* when both the first firing resistor 122*a* and the second firing resistor 122*b* are fired simultaneously, the parasitic resistor 123 may be arranged in the electrical path of the first firing resistor 122*a*. In some of these implementations, the parasitic resistor 123 may have a resistance to reduce or eliminate R-life failure of the first firing resistor 122*a*. In some implementations, the parasitic resistor 123 may have a resistance smaller than the resistance of the first firing resistor 122*a*. For example, the parasitic resistor 123 may have a resistance about half that of the first firing resistor 122*a*. In some implementations, the first firing resistor 122*a* may have a resistance of about 100Ω and the parasitic resistor 123 may have a resistance of about 50Ω. In other implementations, the first firing resistor 122*a* and the parasitic resistor 123 may be configured with other resistances and other resistance ratios.

Figure 4:
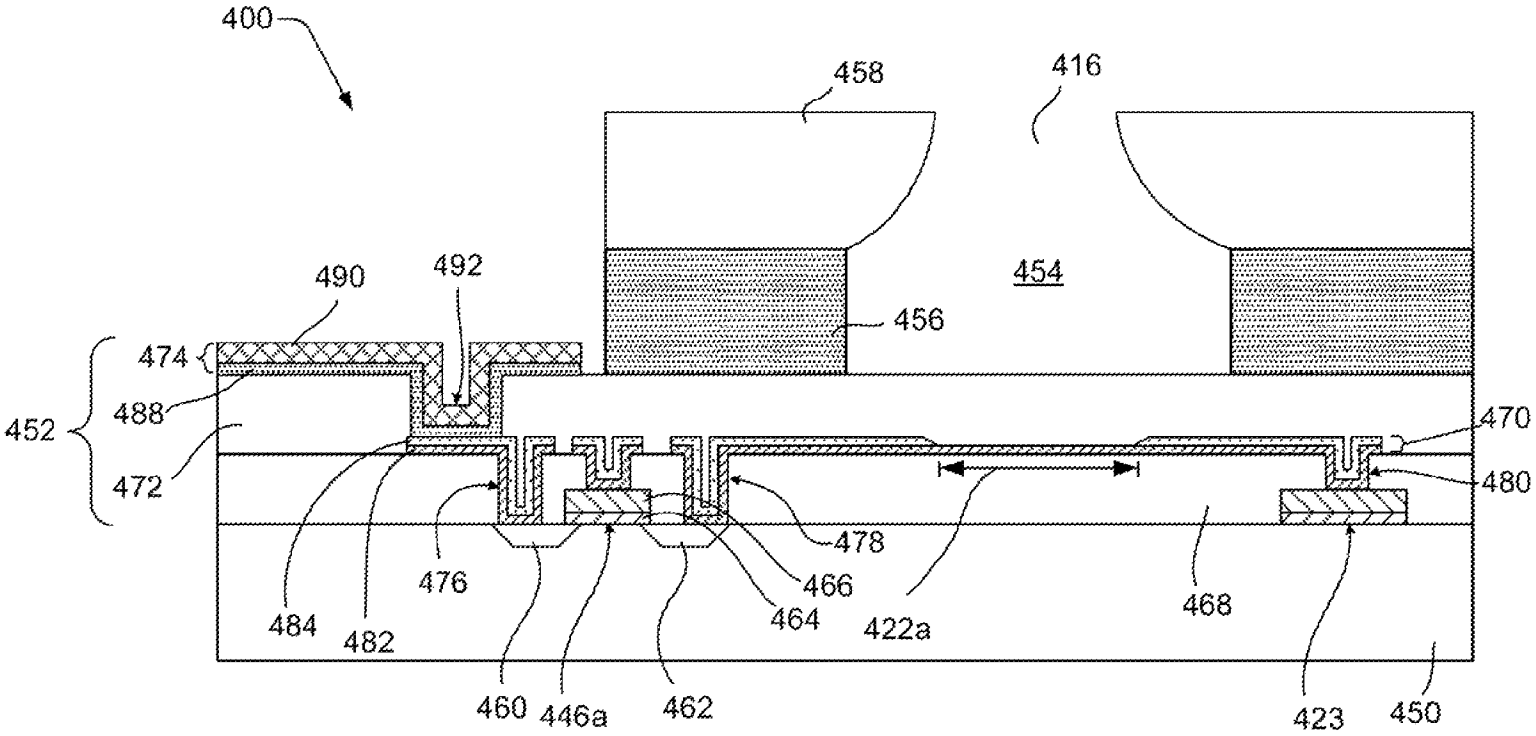
FIG. 4-6 are sectional views of example fluid ejection apparatuses including a parasitic resistor.
Figure 5:
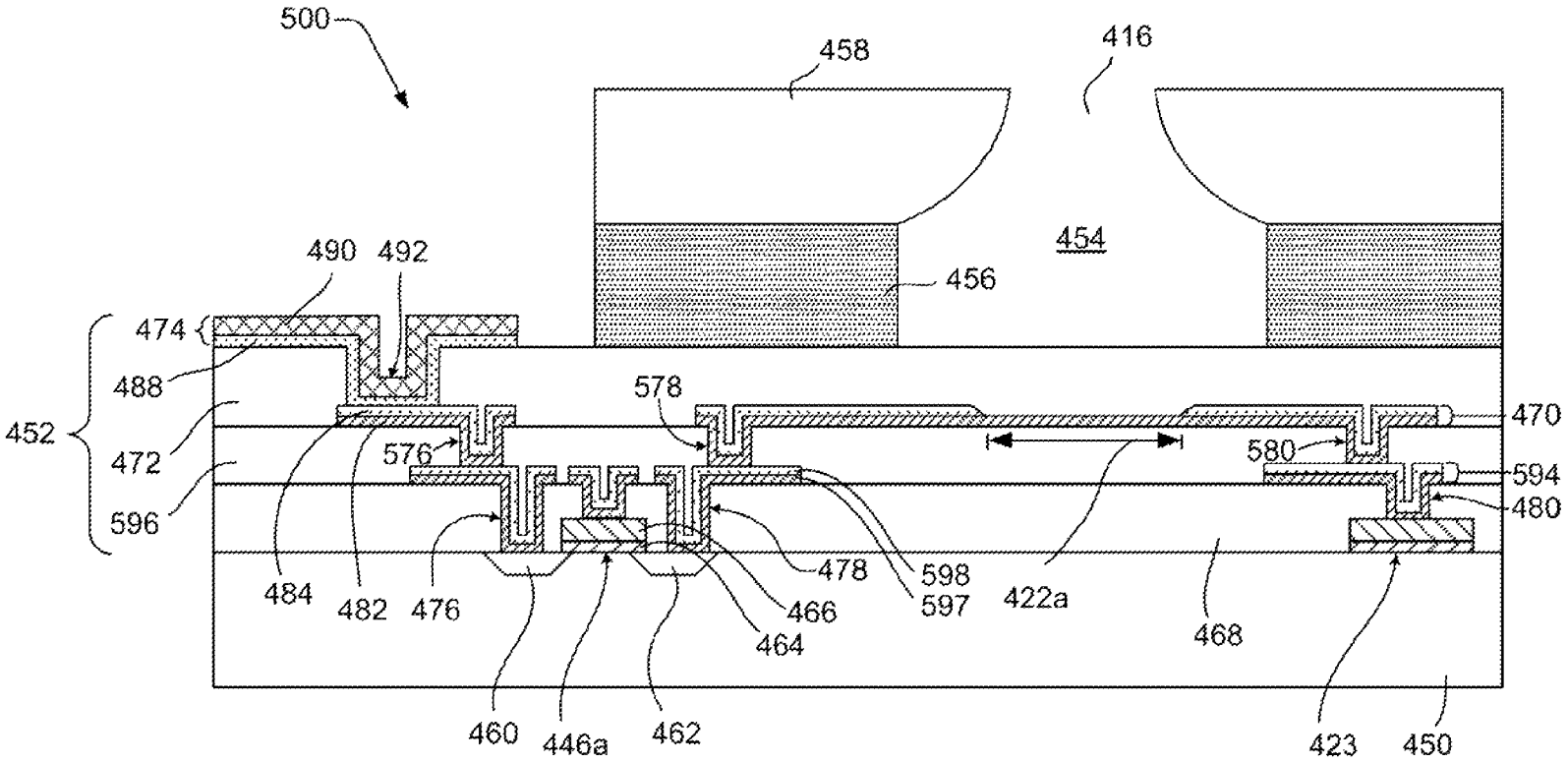
Figure 6:
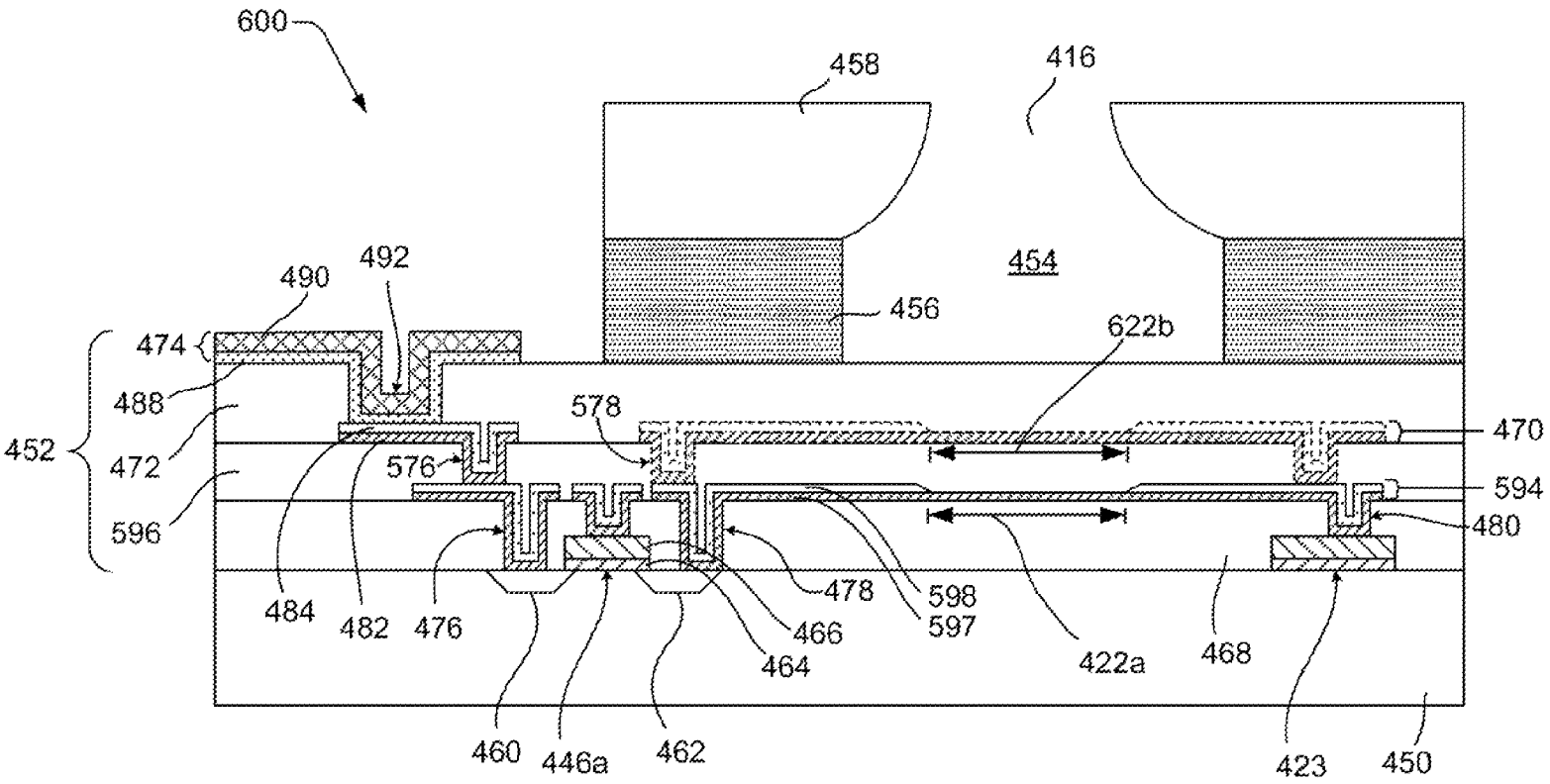

FIGS. 4-6 depict sectional diagrams of several examples of fluid ejection apparatuses including a first firing resistor and a second firing resistor to selectively cause fluid to be ejected through a single nozzle, and a parasitic resistor arranged to add a parasitic resistance to the first firing resistor as described herein.

Turning now to FIG. 4, the fluid ejection apparatus 400 may include a substrate 450, a thin-film stack 452, and a fluid chamber 454 formed on the thin-film stack 452. The fluid chamber 454 may be formed within a barrier layer 456 and a nozzle plate layer 458, each deposited on the thin-film stack 452. The fluid chamber 454 may be fluidically coupled to a nozzle 416. The fluid chamber 454 may be configured to hold fluid (e.g., ink), which can be ejected from the nozzle 416.

The substrate 450 may be a semiconductor substrate having doped regions, such as a doped region 460 and a doped region 462, and the thin-film stack 452 may be formed over the substrate 450. The thin-film stack 452 may include an oxide layer 464, a polysilicon layer 466 on the oxide layer 464, an insulating layer 468 over the patterned oxide layer 464 and polysilicon layer 466, a conductive layer 470 over the insulating layer 468, and insulating layer 472. The thin-film stack 452 may include multiple layers deposited on the substrate 450 in a pattern. The layers in the thin-film stack 452 can be deposited and patterned using known semiconductor deposition and processing techniques. It is to be understood that FIG. 4 shows the thin-film stack 452 in a simplified manner and may omit topology details, such as the varying heights and thicknesses of the layers as they are deposited over the substrate 452.

A portion of the oxide layer 464 may form a gate oxide layer and a portion of the polysilicon layer 466 may form a gate of a drive transistor 446*a*. The doped regions 460 and 462 may form a source and drain of the drive transistor 446*a*. Other portions of the oxide layer 464 and the polysilicon layer 466 may form the parasitic resistor 423. Although the parasitic resistor 423 could be formed using a different material or materials, either on the substrate 450, s shown, or on another layer, forming the parasitic resistor 423 using the same polysilicon layer 466 used for forming the driver transistor 446*a* may have some benefits. Polysilicon may have a high sheet resistivity of about 28-30 Ω/sq and the process for forming the drive transistor 446*a*, or any other transistor on the substrate 450 during the same operation, generally has tight process controls for thickness, critical dimension (CD), and resistivity, and so forming the parasitic resistor 423 during the same operation may facilitate forming the parasitic resistor 423 with the desired resistance and footprint with tight process control. In addition, forming the parasitic resistor 423 under the dielectric layer 428 may result in the layers of the parasitic resistor 423 having less thermal impact and smaller surface adhesion impact on the barrier layer 456 in the downstream process operations than if the parasitic resistor 423 were located elsewhere. Furthermore, forming the parasitic resistor 423 of polysilicon may allow the parasitic resistor 423 to experience less leakage current, with the capability to carry enough current density during nozzle firing, than might be achieved if the parasitic resistor 423 were formed of another material.

The insulating layers 468, 472 may comprise any type of insulating layer, such as silicon oxide, phosphosilicate glass (PSG), borophosphosilicate glass (BPSG), undoped silicate glass (USG), silicon carbide (SiC), silicon nitride (SiN), tetraethyl orthosilicate (TEOS), or the like, or combinations thereof. The insulating layers 468, 472 may comprise the same or different materials.

The conductive layer 470 may comprise any type of conductive layer or layers, such as tantalum (Ta), aluminum (Al), copper (Cu), tungsten (W), gold (Au), silicon (Si), or the like, or combinations thereof (e.g., Ta and Au), including alloys or combinations thereof (e.g., TaAl, AlCu, WSiN, AlCuSi, etc.). For example, conductive layers 482 and 484 are shown, and in some examples, the first conductive layer 482 may comprise WSiN and the second conductive layer 484 may comprise AlCu. In another example, the first conductive layer 482 may comprise TaAl and the second conductive layer 484 may comprise AlCu. Other combinations may be possible within the scope of the present disclosure.

In various implementations, the conductive layers 482, 484 may have different sheet resistances. For example, the conductive layer 482 may have a higher sheet resistance than the conductive layer 484 such that, where the conductive layer 484 is present, the majority of the current goes through the conductive layer 484. Thus, the conductive layer 484 may act as a conducting line and may be used to route signals, and the conductive layer 482 may act as a resistive line and may be used as a resistor. A portion of the conductive layer 482 may be exposed at the surface facing the fluid chamber 454, as shown, which may provide of surface of the first firing resistor 422*a*.

Conductive paths 476, 478, 480 may be formed in the insulating layer 468 to electrically couple the doped region 460 to the metal layer 470, the doped region 462 to the first resistor 422*a*, and the parasitic resistor 423 to the first resistor 422*a*, respectively, as shown.

Although the second firing resistor (see, e.g., second firing resistor 122*b* described herein with reference to FIG. 3) is not explicitly illustrated in FIG. 4, the second firing resistor may be formed on the insulating layer 468 when the first firing resistor 422*a* is formed and may have a configuration similar to that of the first firing resistor 422*a* shown in FIG. 4 with differences to account for the differing resistance values. In other words, the first firing resistor 422*a* illustrated in FIG. 4 may look virtually identical to the second firing resistor except that the second firing resistor may have a larger area and would not be electrically coupled to the parasitic resistor 423 by the conductive path 480.

The conductive layer 474 may comprise any type of conductive layer or layers, similar to the conductive layer 470, such as, for example, Ta, Al, Cu, W, Au, Si, or the like, or combinations thereof (e.g., Ta and Au), including alloys or combinations thereof (e.g., TaAl, AlCu, WSiN, AlCuSi, etc.). As shown, for example, the conductive layer 474 may include a conductive layer 488 and a conductive layer 490. The conductive layer 490 may be used to provide a bond pad 492 for receiving electrical signals from an external source (not shown).

It is to be understood that the layers of the thin-film stack 452 may not be shown to scale. The layers may have various thicknesses depending on particular device configuration and processes used. In an example, the oxide layer 464 may have a thickness on the order of 750 Angstroms (A); the polysilicon layer 466 on the order of 3600 A; the dielectric layer 468 on the order of 13000 A; the metal layer 470 on the order of 5000 A; the dielectric layer 472 on the order of 3850 A; and the metal layer 474 on the order of 4600 A. These thicknesses are merely examples and other configurations may be possible.

Additionally, the particular configuration of layers in the thin-film stack 452 is also provided by way of example. It is to be understood that additional dielectric and/or metal layers may be provided in different configurations. FIGS. 5 and 6 illustrate examples of such variations. FIGS. 5 and 6 illustrate fluid ejection apparatuses 500 and 600, respectively, that include similar elements as those described herein with reference to FIG. 4 and these similar elements in FIGS. 5 and 6 are not described again to avoid redundancy and for ease of explanation. Similar elements are indicated using the same reference numbers used in FIG. 4.

As shown in FIG. 5, the fluid ejection apparatus 500 includes another conductive layer 594 and another insulating layer 596 between the drive transistor 446*a*/parasitic resistor 423 layer and the conductive layer 470. The conductive layer 594 may comprise any type of conductive layer or layers, similar to the conductive layers 470, 474. As shown, for example, the conductive layer 594 may include a conductive layer 597 and a conductive layer 598. In other implementations, the conductive layer 594 may be omitted. The fluid ejection apparatus 500 may include conductive paths 576, 578, 580 to electrically couple, at least in part, the doped region 460 to the metal layer 470, the doped region 462 to the first resistor 422*a*, and the parasitic resistor 423 to the first resistor 422*a*, respectively, as shown.

FIG. 6 illustrates another example of a fluid ejection apparatus 600. As shown, the fluid ejection apparatus 600 includes the conductive layers 594 and another insulating layer 506 between the drive transistor 446*a*/parasitic resistor 423 layer and the conductive layer 470. As shown, however, the conductive layer 594 forms a second resistor 622*b*. The second resistor 622*b* may be stacked over the first resistor 422*a*, may overlap the first resistor 422*a*, or may be offset from the first resistor 422*a* such that there is no overlap. In the illustrated example, the second resistor 422*b* is not stacked directly over the 422*a* (and thus is shown by hashed lines). The conductive paths 576, 580 may electrically couple, at least in part, the doped region 460 to the metal layer 470, the doped region 462 to the first resistor 422*a*, and the parasitic resistor 423 to the first resistor 422*a*, respectively, as shown. The conductive path 578 may electrically couple the second resistor 422*b* to another doped region of another drive transistor (not illustrated).

Figure 7:
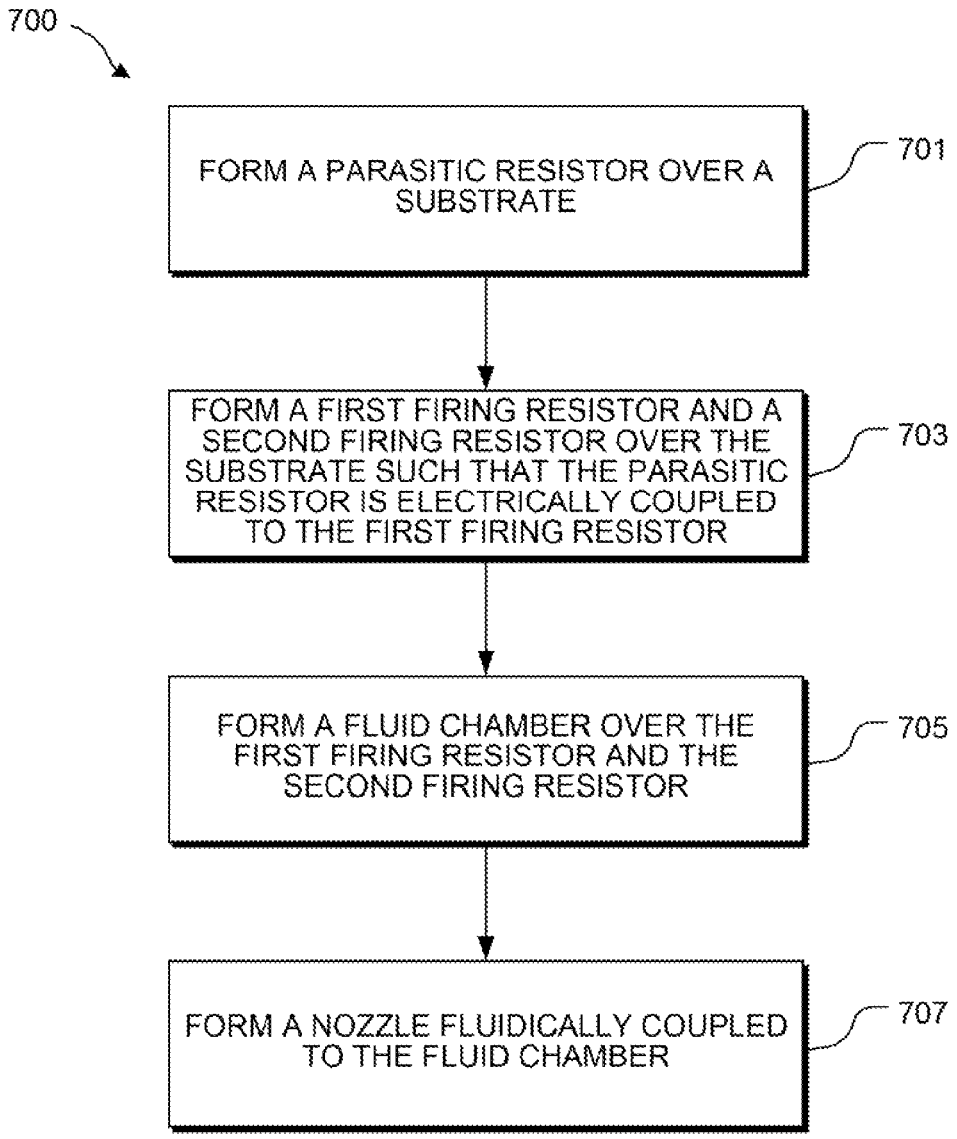
FIG. 7 is a flow diagram illustrating an example of a method for making a fluid ejection apparatus.
Figure 8:
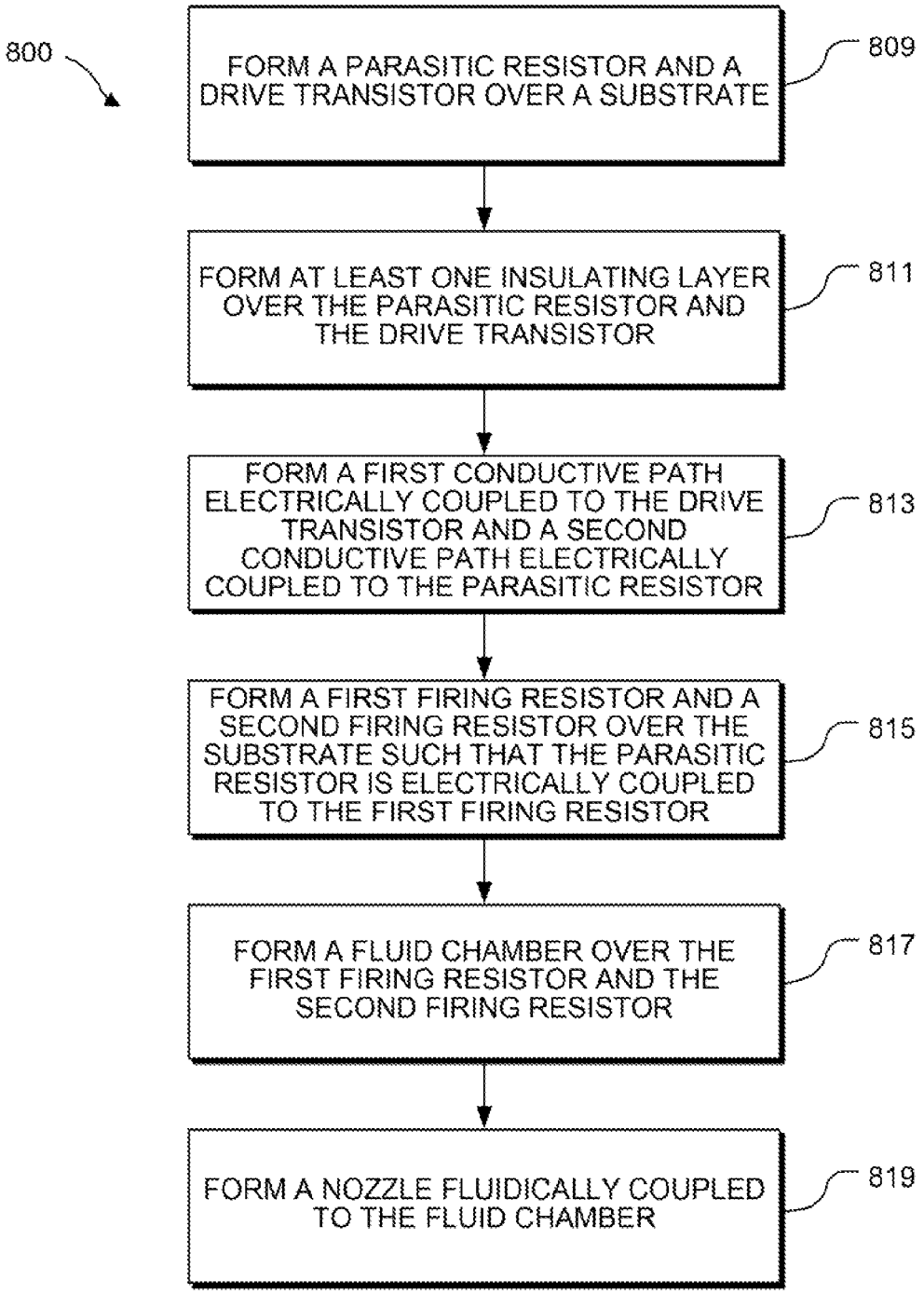
FIG. 8 is a flow diagram illustrating another example of a method for making a fluid ejection apparatus.

FIGS. 7 and 8 are flow diagrams illustrating example methods 700 and 800, respectively, for making a fluid ejection apparatus including a first firing resistor and a second firing resistor to selectively cause fluid to be ejected through a single nozzle, and a parasitic resistor arranged to add a parasitic resistance to the first firing resistor. The methods may be associated with the various implementations described herein, and details of the operations shown in the methods 700, 800 may be found in the related discussion of such implementations. It is noted that various operations discussed and/or illustrated may be generally referred to as multiple discrete operations in turn to help in understanding various implementations. Some implementations may include more or fewer operations than my be described.

Turning now to FIG. 7, the method 700 may begin or proceed with forming a parasitic resistor over a substrate at block 701. The parasitic resistor may be formed directly on the substrate or on an intervening layer between the substrate and the parasitic resistor. The parasitic resistor may comprise at least a polysilicon layer. As described herein, the parasitic resistor may be formed during a same operation as forming one or more drive transistors.

The method 700 may proceed to block 703 with forming a first firing resistor and a second firing resistor over the substrate such that the parasitic resistor is electrically coupled to the first firing resistor to add a parasitic resistance to the first firing resistor. The firing resistors may be formed such that the parasitic resistor and/or drive transistor, and one more insulating layers, are between the firing resistors and the substrate. In various implementations, the substrate may comprise a semiconductor substrate and the method 700 may include doping the substrate, prior to forming the firing resistors, to form doped regions that provide source and drain regions of the drive transistor.

The method 700 may proceed to block 705 with forming a fluid chamber over the firing resistors, and then forming a nozzle fluidically coupled to the fluid chamber at block 707. The fluid chamber may be defined, at least in part, by a barrier layer and a nozzle plate layer. The nozzle may be formed in the nozzle plate layer.

Turning now to FIG. 8, the method 800 may begin or proceed with forming a parasitic resistor and at least one drive transistor over a substrate at block 809. The parasitic resistor and the drive transistor may be formed directly on the substrate or on an intervening layer between the substrate and the parasitic resistor/drive transistor. In various implementations, the substrate may comprise a semiconductor substrate and the method 700 may include doping the substrate, prior to forming the firing resistors, to form doped regions that provide source and drain regions of the drive transistor. The parasitic resistor and drive transistor may comprise similar layer stacks include at least a polysilicon layer. In many implementations, forming the parasitic resistor and drive transistor may comprise forming an oxide layer over the substrate, forming a polysilicon layer over the oxide layer, etching the stack (oxide layer/polysilicon layer), and doping the polysilicon layer.

The method 800 may proceed to block 811 with forming at least one insulating layer over the parasitic resistor and drive transistor, and then to block 813 with forming, in the at least one insulating layer, a first conductive path electrically coupled to the drive transistor and a second conductive path electrically coupled to the parasitic resistor.

The method 800 may proceed to block 815 with forming a first firing resistor and a second firing resistor over the substrate such that the parasitic resistor is electrically coupled to the first firing resistor to add a parasitic resistance to the first firing resistor. In various implementations, forming the first firing resistor may comprise forming the first firing resistor over the at least one insulating layer such that the first firing resistor is electrically coupled to the first conductive path and the second conductive path. In this configuration, the first firing resistor may be electrically coupled to the parasitic resistor and the drive transistor.

The method 800 may proceed to block 817 with forming a fluid chamber over the firing resistors, and then forming a nozzle fluidically coupled to the fluid chamber at block 819. The fluid chamber may be defined, at least in part, by a barrier layer and a nozzle plate layer. The nozzle may be formed in the nozzle plate layer.

Although certain implementations have been illustrated and described herein, it will be appreciated by those of ordinary skill in the art that a wide variety of alternate and/or equivalent implementations calculated to achieve the same purposes may be substituted for the implementations shown and described without departing from the scope of this disclosure. Those with skill in the art will readily appreciate that implementations may be implemented in a wide variety of ways. This application is intended to cover any adaptations or variations of the implementations discussed herein. It is manifestly intended, therefore, that implementations be limited only by the claims and the equivalents thereof.

What is claimed is:

1. A fluid ejection apparatus comprising:

a first firing resistor and a second firing resistor to selectively cause fluid to be ejected through a single nozzle; and a parasitic resistor arranged to add a parasitic resistance to the first firing resistor.

2. The fluid ejection apparatus of claim 1, wherein the first firing resistor and the second firing resistor have different resistances.

3. The fluid ejection apparatus of claim 2, wherein the second firing resistor has a resistance greater than a resistance of the first firing resistor.

4. The fluid ejection apparatus of claim 1, wherein the first firing resistor is a low drop-weight resistor and the second firing resistor is a high drop-weight resistor.

5. The fluid ejection apparatus of claim 1, wherein the first firing resistor is to produce a fluid drop having a first size and the second firing resistor is to produce a fluid drop having a second size greater than the first size.

6. The fluid ejection apparatus of claim 1, wherein the first firing resistor and the second firing resistor are arranged to receive a same firing voltage.

7. The fluid ejection apparatus of claim 1, wherein the parasitic resistor comprises polysilicon.

8. The fluid ejection apparatus of claim 1, wherein the first firing resistor comprises at least one metal selected from the group comprising TaAl, WSiN, and TaSiN.

9. The fluid ejection apparatus of claim 1, wherein the second firing resistor comprises at least one metal selected from the group comprising TaAl, WSiN, and TaSiN.

10. The fluid ejection apparatus of claim 1, wherein the parasitic resistor is connected in series with the first firing resistor.

11. The fluid ejection apparatus of claim 1, wherein the first firing resistor comprises a resistive conductive layer that is electrically connected to the parasitic resistor.

12. The fluid ejection apparatus of claim 11, wherein the parasitic resistor comprises a polysilicon segment formed in a polysilicon layer, and the polysilicon segment is electrically connected to the resistive conductive layer.

13. The fluid ejection apparatus of claim 1, further comprising a transistor connected to the first firing transistor, wherein the transistor comprises a polysilicon segment formed in the polysilicon layer.

14. The fluid ejection apparatus of claim 1, wherein the first firing resistor comprises a resistive conductive layer that is electrically connected to the parasitic resistor through a conductor layer.

15. A fluid ejection system comprising:

a fluid reservoir;

a printhead to receive a fluid from the fluid reservoir, the printhead including:

a nozzle;

a fluid chamber fluidically coupled to the fluid reservoir;

a first firing resistor to thermally eject the fluid from the fluid chamber through the nozzle;

a second firing resistor to thermally eject the fluid from the fluid chamber through the nozzle; and a parasitic resistor connected in series with the first firing resistor to add a parasitic resistance to the first firing resistor to control an amount of energy across the first firing resistor; and select circuitry to facilitate, at least in part, ejection of the fluid by the first firing resistor, by the second firing resistor, or by the first firing resistor and the second firing resistor.

16. The fluid ejection system of claim 15, further comprising a firing line arranged to provide a firing voltage to the first firing resistor and the second firing resistor.

17. The fluid ejection system of claim 15, wherein the select circuitry is coupled to a first drive transistor to select the first firing resistor to eject the fluid and a second drive transistor to select the second firing resistor to eject the fluid.

18. A method for making a fluid ejection apparatus, comprising:

forming a parasitic resistor over a substrate;

forming a first firing resistor and a second firing resistor over the substrate such that the parasitic resistor is electrically coupled in series to the first firing resistor to add a parasitic resistance to the first firing resistor;

forming a fluid chamber over the first firing resistor and the second firing resistor; and forming a nozzle fluidically coupled to the fluid chamber.

19. The method of claim 18, wherein said forming the parasitic resistor comprises forming an oxide layer over the substrate, forming a polysilicon layer over the oxide layer, and doping the polysilicon layer.

20. The method of claim 18, further comprising:

forming a drive transistor over the substrate;

forming at least one insulating layer over the parasitic resistor and the drive transistor; and forming, in the at least one insulating layer, a first conductive path electrically coupled to the drive transistor and a second conductive path electrically coupled to the parasitic resistor;

wherein said forming the first firing resistor comprises forming the first firing resistor over the at least one insulating layer and electrically coupled to the first conductive path and the second conductive path.

* * * * *